US007182238B2

(12) United States Patent
Haramiishi

(10) Patent No.: US 7,182,238 B2
(45) Date of Patent: Feb. 27, 2007

(54) SHEET STAPLE FEEDING MECHANISM

(75) Inventor: Kiichi Haramiishi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 461 days.

(21) Appl. No.: 10/483,307

(22) PCT Filed: Jul. 9, 2002

(86) PCT No.: PCT/JP02/06938

§ 371 (c)(1),
(2), (4) Date: Jan. 8, 2004

(87) PCT Pub. No.: WO03/006212

PCT Pub. Date: Jan. 23, 2003

(65) Prior Publication Data

US 2004/0164118 A1 Aug. 26, 2004

(30) Foreign Application Priority Data

Jul. 10, 2001 (JP) ..... 2001-208907

(51) Int. Cl.
*B25B 5/16* (2006.01)

(52) U.S. Cl. ..... 227/120; 227/119; 227/136; 227/156

(58) Field of Classification Search ..... 227/120, 227/156, 119, 136
See application file for complete search history.

(56) References Cited

U.S. PATENT DOCUMENTS 6,039,230 A * 3/2000 Yagi et al. ..... 227/120
6,050,471 A * 4/2000 Yagi ..... 227/119
6,371,351 B1 * 4/2002 Magnusson ..... 227/119
6,371,352 B1 * 4/2002 Mochizuki ..... 227/155
6,568,579 B2 * 5/2003 Mochizuki ..... 227/131
6,719,181 B2 * 4/2004 Kanai et al. ..... 227/2
6,899,258 B2 * 5/2005 Haramiishi ..... 227/2
6,997,366 B2 * 2/2006 Manabe ..... 227/120
7,048,165 B2 * 5/2006 Haramiishi ..... 227/3
2003/0111506 A1 * 6/2003 Kanai et al. ..... 227/131

FOREIGN PATENT DOCUMENTS

SE 0003658-2 * 10/2001 ..... 227/119

* cited by examiner

*Primary Examiner*—John Sipos
*Assistant Examiner*—Michelle Lopez
(74) *Attorney, Agent, or Firm*—Chapman and Cutler LLP

(57) ABSTRACT

A feeding mechanism for sheet staple comprises a reciprocating member (12) which is provided under a cartridge in which stacked sheet staples are contained and which is reciprocated forwardly and backwardly in response to up and down movements of a driver for driving the sheet staples, a feeding pawl (20) mounted rotatably by a predetermined angle in forward and backward directions on the reciprocating member (12) for rotating in a raised direction as the reciprocating member moves forwardly, and a spring (13) for biasing forwardly the reciprocating member (12).

Each of the sheet staples is fed out forwardly by raising of the feeding pawl (20).

One end of the spring (13) is engaged in a lower side than a center of rotation of the feeding pawl (20). The reciprocating member (12) is urged forwardly through the feeding pawl (20).

2 Claims, 10 Drawing Sheets

SHEET STAPLE FEEDING MECHANISM

TECHNICAL FIELD

The present invention relates to a feeding mechanism for sheet staple for feeding out sheet staples stacked and contained in a cartridge in a forward direction.

BACKGROUND ART

Conventionally, there is known a feeding mechanism 900 for sheet staple, which is arranged underneath a cartridge (not shown) in which sheet staples ST are stacked and contained, as shown in FIGS. 13 and 14.

The feeding mechanism 900 is composed of a ratchet plate 901 extending forwardly and backwardly, a feeding pawl 910, a spring guide 920, a feeding spring 930 for biasing forwardly the ratchet plate 901 and so on. A leading end of the ratchet plate 901 is formed with an inclined surface 902 and a concave portion (not shown) of a driver 350 is abutted with the inclined surface 902.

As the concave portion is abutted with the inclined surface 902 of the ratchet plate 901 by upward movement of the driver 350, the ratchet plate 901 is moved backwardly (rightward) against a biasing force of the feeding spring 930 as the driver 350 moves upwardly.

As the ratchet plate 901 is moved backwardly, the feeding pawl 910 is fallen down as shown in FIG. 15. This fall down of feeding pawl is carried out by the feeding pawl 910 being rotated centering on a hole 904 of the ratchet plate 901 in counterclockwise.

As driving of the sheet staple S is completed by the upward movement of the driver 350, and the driver 350 and a forming plate 351 are lowered in an initial position, the spring guide 920 urges forwardly the feeding pawl 910 by means of a biasing force of the feeding spring 930.

At this time, the feeding pawl 910 is raised up by means of the inclined surface 922 of the spring guide 920 as shown in FIG. 13. In other words, from such a state that a clearance is generated between the feeding pawl 910 and the inclined surface 922 of the spring guide 920 as shown in FIG. 15, the feeding pawl 910 is in surface contact with the inclined surface 922 of the spring guide 920 so as to eliminate the clearance as shown in FIG. 13.

As the ratchet plate 901 moves forwardly together with the spring guide 920 by the biasing force of the feeding spring 930, a pawl part 911 of the raised feeding pawl 910 is inserted between the staples in the sheet staples ST. Consequently, the feeding pawl 910 feeds out forwardly each of the sheet staples ST according to the movement of the ratchet plate 901.

However, because the aforementioned feeding mechanism 900 for sheet staple is composed of the ratchet plate 901, feeding pawl 910, spring guide 920, feeding spring 930 and so on, there is a problem that a great number of parts are required.

An object of the present invention is to provide a feeding mechanism for sheet staple capable of minimizing the number of parts.

DISCLOSURE OF INVENTION

To accomplish the above object, the invention recited in claim 1 is characterized in that there is provided a feeding mechanism for sheet staple comprising a reciprocating member which is provided beneath a cartridge in which stacked sheet staples are contained and which is reciprocated forwardly and backwardly in response to up and down movements of a driver for driving the sheet staples, a feeding pawl mounted rotatably by a predetermined angle in forward and backward directions on the reciprocating member for rotating in a raised direction as the reciprocating member moves forwardly and a spring for biasing forwardly the reciprocating member.

Each of the sheet staples is fed out forwardly by raising of the feeding pawl.

One end of the spring is engaged in a lower side than a center of rotation of the feeding pawl. The reciprocating member is also urged forwardly through the feeding pawl.

<Operation>

The feeding pawl is raised up by means of a biasing force of the feeding spring for the reason that one end of the spring is locked in a lower side than a center of rotation of the feeding pawl and the reciprocating member is urged forwardly through the feeding pawl.

Accordingly, any member for casing the feeding pawl to raise up is not needed to minimize the number of the parts in the feeding mechanism.

BEST MODE FOR CARRYING OUT THE INVENTION

A best mode for carrying out a feeding mechanism for sheet staples according to the present invention will be explained in connection with the accompanying drawings below.

Figure 1:
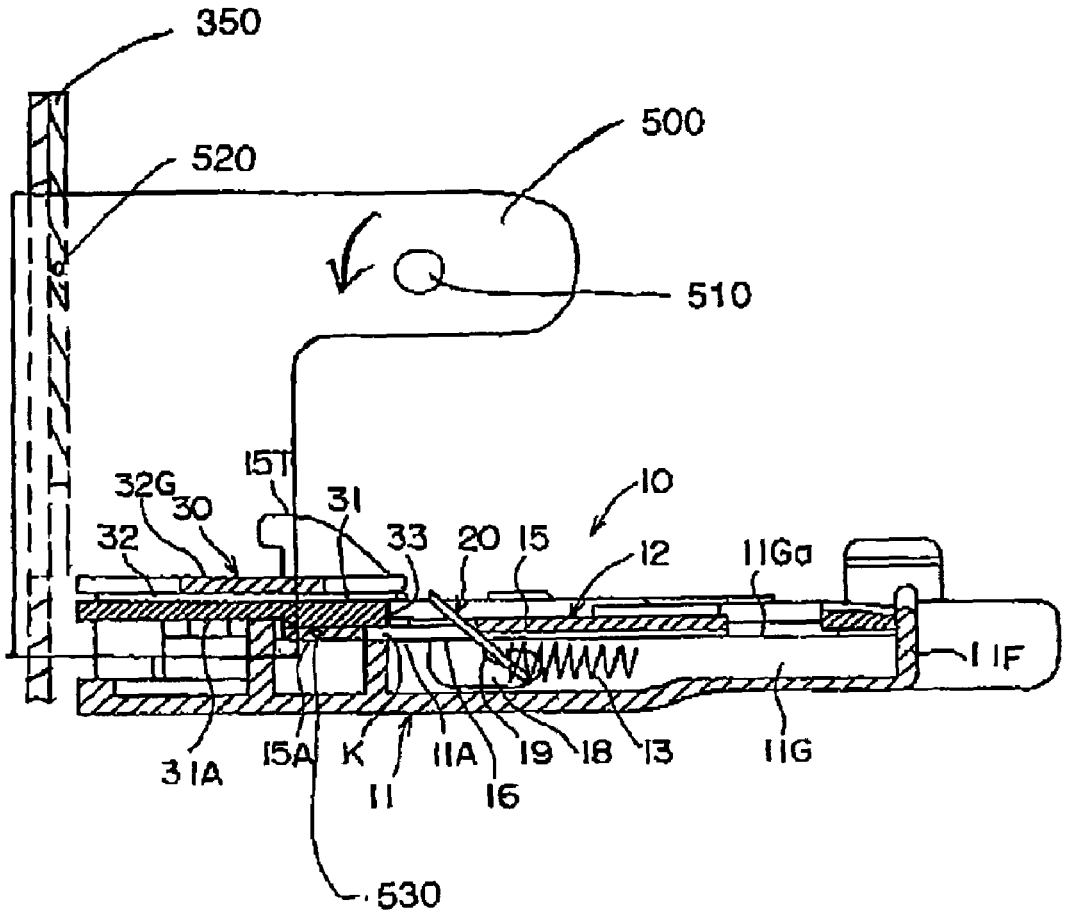
FIG. 1 is a sectional view showing a structure of a feeding mechanism according to the present invention.
Figure 3:
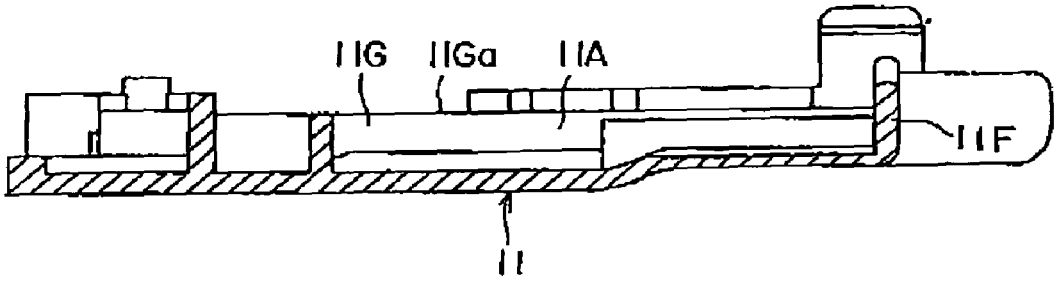
FIG. 3 is a sectional view showing the staple guide holder on which the feeding mechanism as shown in FIG. 1 is provided.

In FIG. 1, reference numeral 10 denotes a feeding mechanism for sheet staples, provided under a cartridge (not shown) in which stacked sheet staples (not shown) are contained. The feeding mechanism 10 is composed of a reciprocating member 12 arranged movably forwardly and backwardly on a staple guide holder 11, a feeding pawl 20 mounted on the reciprocating member 12 and a feeding spring (spring) 13 for biasing forwardly the reciprocating member 12. Schematically illustrated in FIG. 1 are a link mechanism 500, configured to change downward movement of the driver 350 to lateral movement of the reciprocating member 12, a connecting pin 520 connecting the link mechanism 500 to the driver 350 and a moving pin 530 for moving the reciprocating member 12. The link mechanism 500 is supported on supporting shaft 510.

Figure 4:
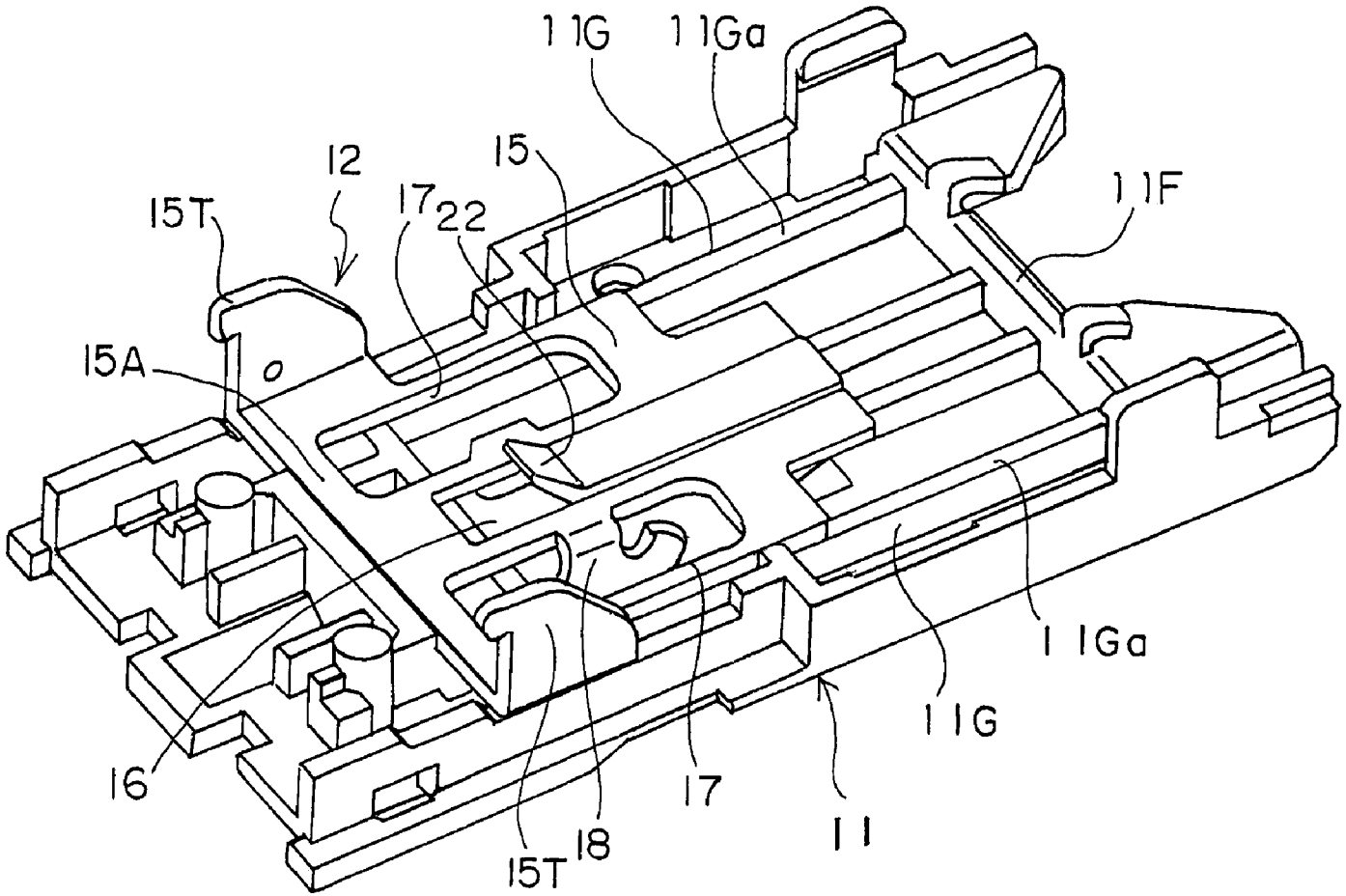
FIG. 4 is a perspective view showing a state that a reciprocating member is mounted on the staple guide holder.

The staple guide holder 11 is formed into a box-like shape whose upper surface is opened and its height is lower and which is attached to a lower portion of the cartridge which is not shown. The opposite side portions of the staple guide holder 11 are formed with a pair of guide walls 11G, 11G extending forwardly and backwardly. As shown in FIG. 4, the reciprocating member 12 is mounted to move forwardly and backwardly on the upper surfaces 11 Ga, 11 Ga of the guide walls 11G, 11G.

Figure 2:
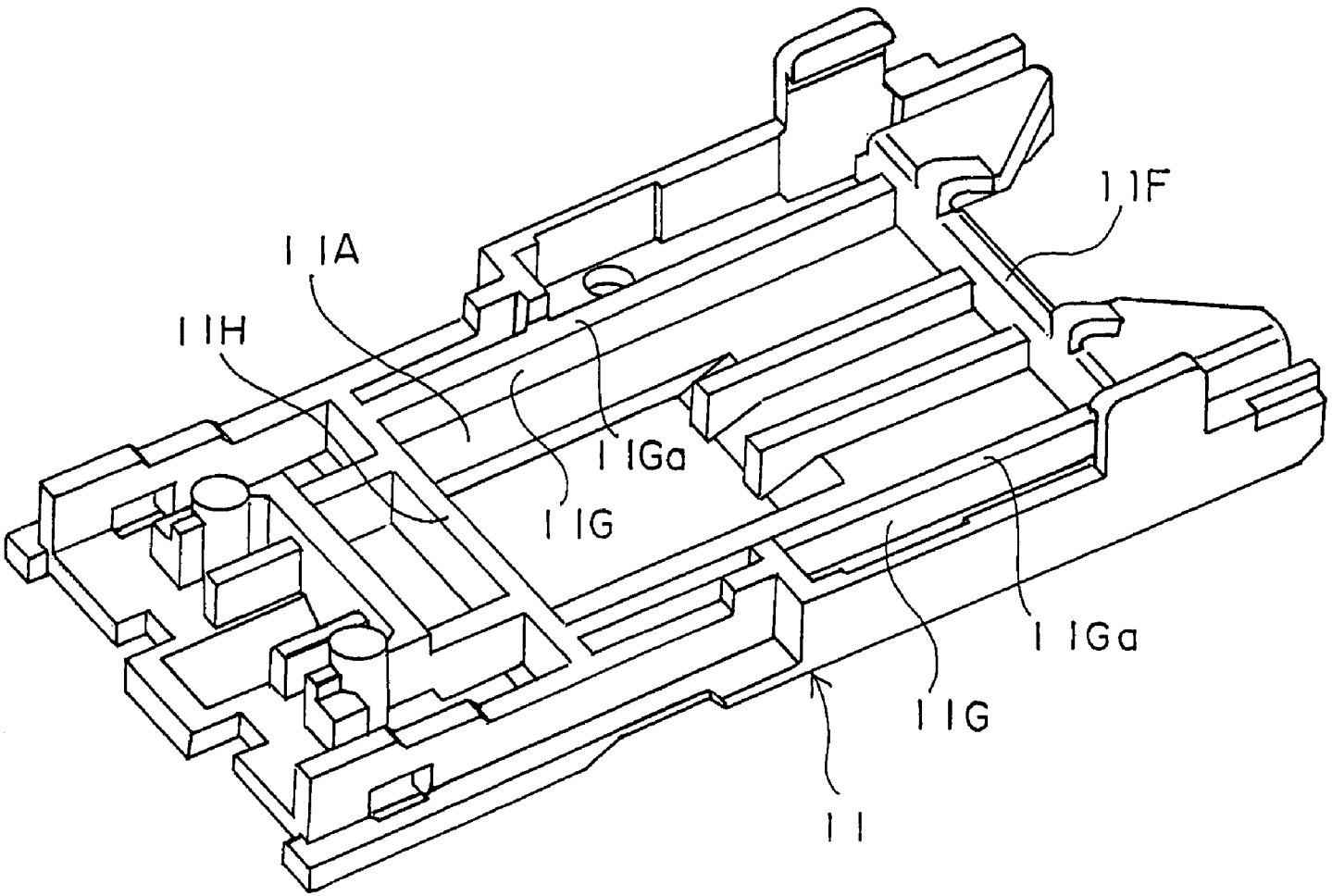
FIG. 2 is a perspective view showing a staple guide holder on which a feeding mechanism as shown in FIG. 1 is provided.
Figure 5:
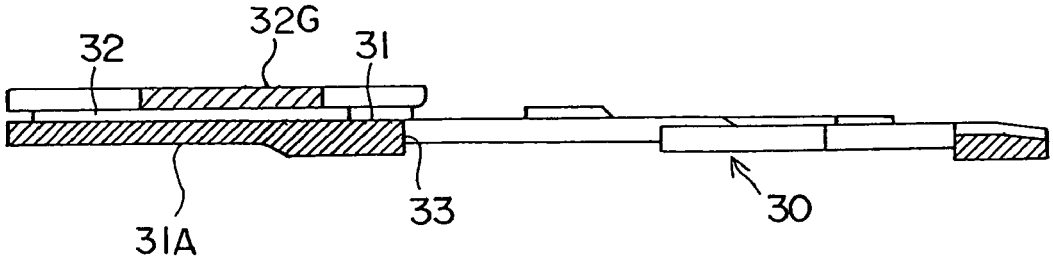
FIG. 5 is a sectional view showing the staple guide holder.

A staple guide 30 (see FIG. 1) is also attached on the staple guide holder 11. The staple guide 30 has a flat receiving part 31 for receiving the sheet staple contained in the cartridge and a guide wall 32 G provided above the a front portion 31 A of the receiving part 31 to form a transporting path 32 for feeding forwardly the sheet staple by means of the guide wall 32 and front portion 31A of the receiving part 31 as shown in FIG. 5. Formed in the central portion of the receiving part 31 is an opening 33 facing to an opening 11A of the staple guide holder 11. The opening 11 A is formed by the guide walls 11G, 11G, a back wall 11 F and a front wall 11 H (see FIG. 2).

A predetermined sized space K is formed between the front portion of the receiving part 31 in the staple guide 30 and the upper surfaces 11 Ga, 11Ga of the guide walls 11 G, 11G in the staple guide holder 11.

Figure 6:
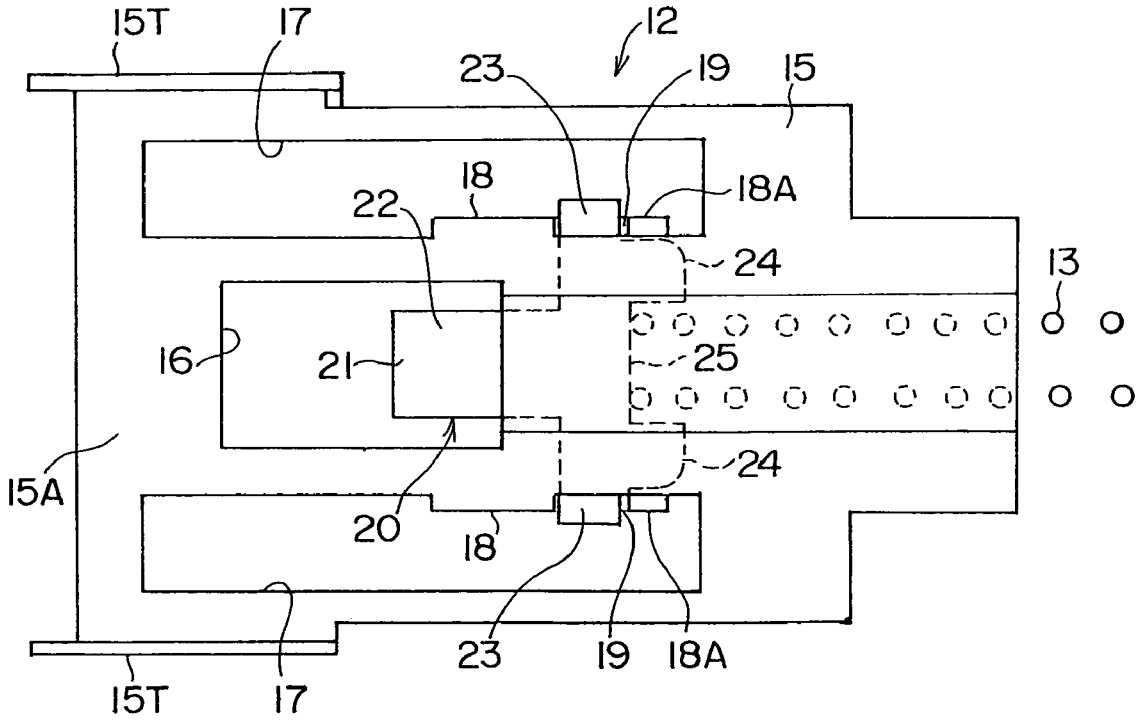
FIG. 6 is a plane view showing the reciprocating member in the feeding mechanism.
Figure 7:
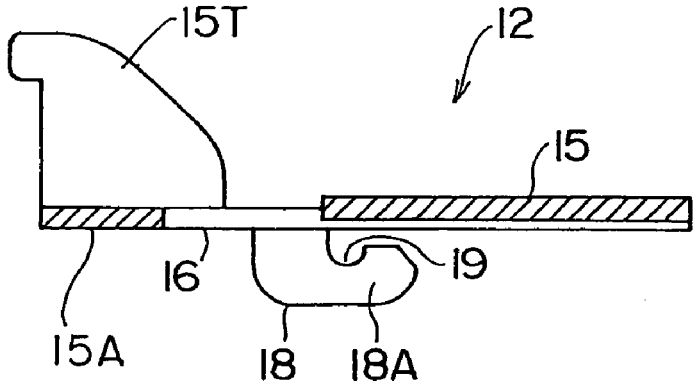
FIG. 7 is a sectional view showing the reciprocating member shown in FIG. 6.
Figure 8:
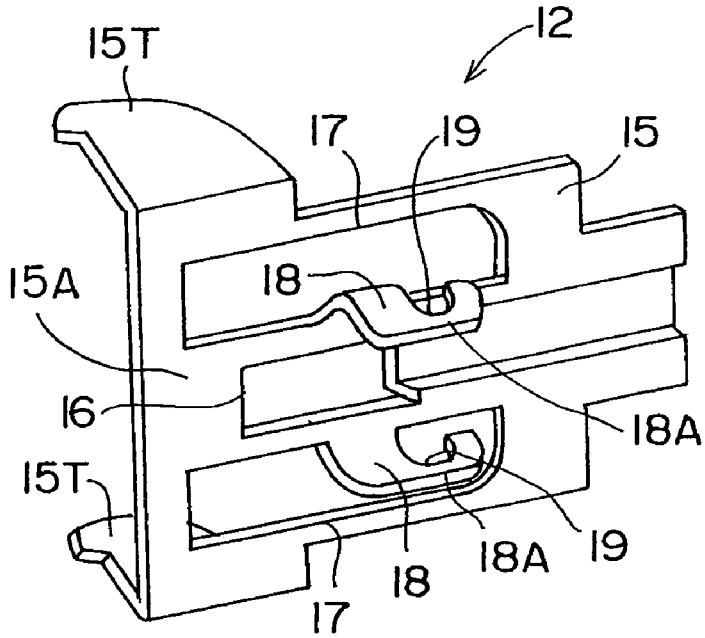
FIG. 8 is a perspective view showing the reciprocating member.

As shown in FIGS. 6 to 8, the reciprocating member 12 has a flat plate-like basic plate portion 15 whose forward central part is formed with a rectangular opening 16 in the opposite sides of which forwardly and backwardly extending openings 17,17 are formed. The openings 17, 17 are formed at their inside side edges with a pair of downwardly projecting (as viewed in FIGS. 4 and 7) supporting pieces (supporting plate portions) 18, 18 which have backwardly extending supporting portions 18A, 18A. Upper portions of the supporting portions 18A, 18 A are formed with concave portions 19, 19 which have circular curved surfaces. The opposite sides at a leading portion of the basic plate portion 15 are formed with a pair of upwardly projecting wall portions 15T, 15T.

The reciprocating member 12 can be reciprocated forwardly and backwardly by means of a link mechanism (not shown) responding to up and down reciprocating movements of a driver (not shown).

Figure 9:
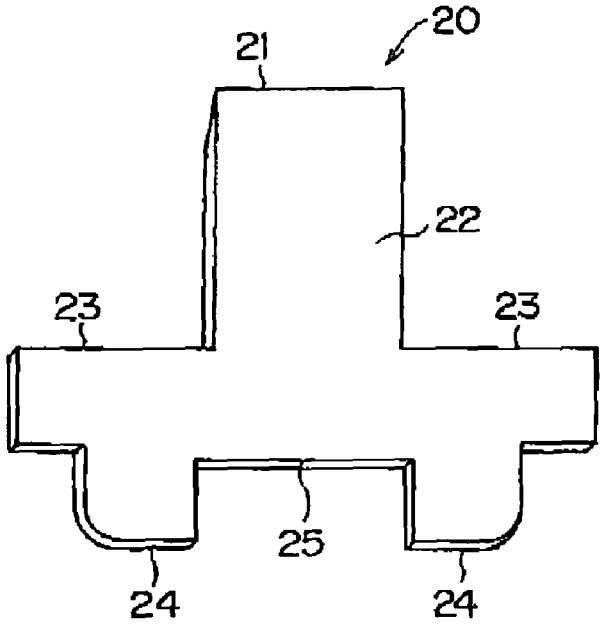
FIG. 9 is a perspective view showing a feeding pawl.

As shown in FIG. 9, the feeding pawl 20 includes a rectangular pawl plate 22 having a pawl portion whose leading end is sharply pointed, a pair of engaging portions 23,23 which project sideward from the back end of the pawl plate 22 and projecting portions 24, 24 which project backwardly from back portions of the engaging portions 23, 23. A concave portion 25 formed by the projecting portions 24,24 acts as a spring receiving portion.

Figure 10:
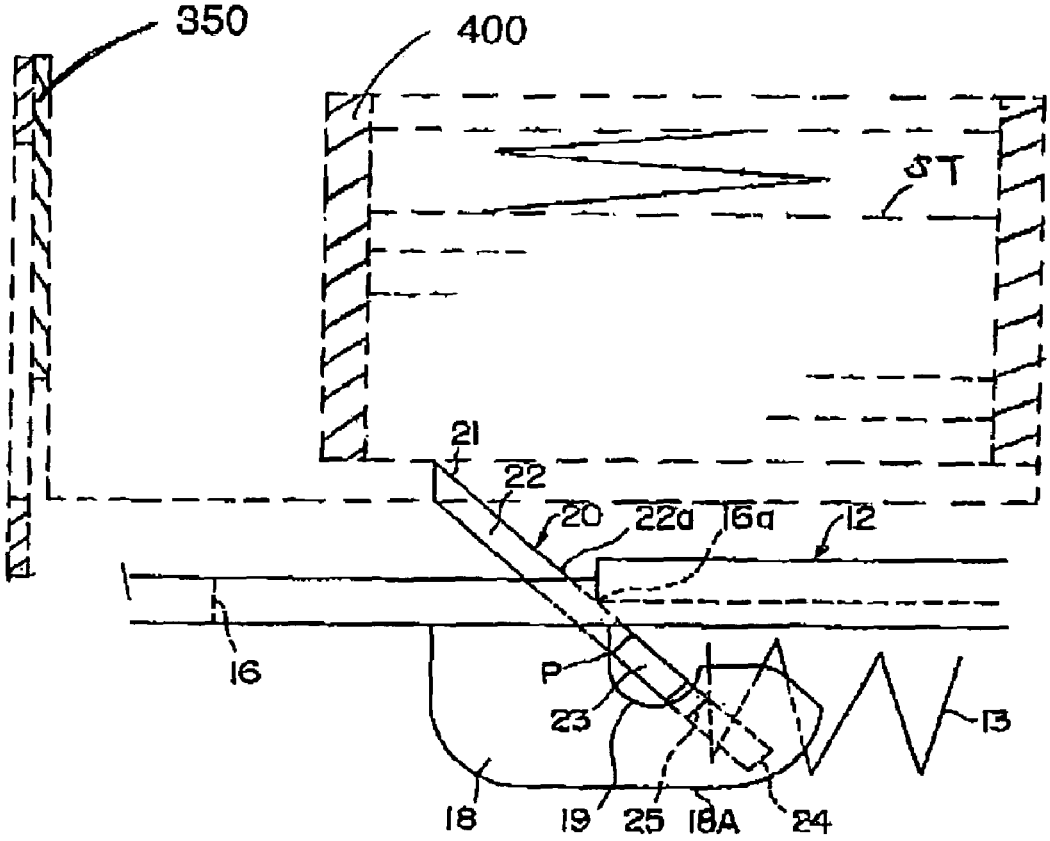
FIG. 10 is an explanatory view showing a state that the feeding pawl is mounted on the reciprocating member.

The engaging portions 23, 23 of the feeding pawl 20 are engaged with the concave portions 19, 19 of the supporting portions 18 A, 18A in the reciprocating member 12 to be rotated within the concave portions 19, 19, as shown in FIGS. 6 and 10. The leading end of the pawl plate 22 of the feeding pawl 20 extends upwardly passing through the opening 16 of the reciprocating member 12.

The front portion 15 A of the basic plate portion 15 in the reciprocating member 12 is inserted into the space k between the front portion of the receiving part 31 in the staple guide 30 and the upper surfaces 11Ga, 11Ga of the guide walls 11 G, 11G in the staple guide holder 11 (see FIG. 1). As shown in FIG. 6, one end of a feeding spring 13 is engaged with the concave portion 25 of the feeding pawl 20. The feeding spring 13 is disposed within the staple guide holder 11 and the other end of the feeding spring 13 is engaged with the back wall 11*f* of the staple guide holder 11.

As shown in FIG. 10, showing the feeding mechanism provided under the cartridge 400, the feeding pawl 20 is biased clockwise about a point P at which the engaging portions 23 of the feeding pawl 20 abut with the concave portion 19 of the reciprocating member 12 by the biasing force of the feeding spring 13 for the reason that the concave portion 25 of the feeding pawl 20 is positioned under the engaging portions 23. This biasing clockwise causes the feeding pawl to raise up until an upper surface 22*a* of the pawl plate 22 in the feeding pawl 20 is abutted with a back edge 16 a of the opening 16.

When the feeding pawl 20 is raised up to a position as shown in FIG. 10, the rotation of the feeding pawl 20 is stopped. Namely, the feeding pawl 20 is in a fixed state in a position shown in FIG. 10. Consequently, the reciprocating member 12 moves forwardly together with the feeding pawl 20 by means of the biasing force of the feeding spring 13.

As the feeding pawl 20 is raised up, the pawl portion 21 thereof arrives to the level of the transporting path 32, passing through the opening 33 of the staple guide 30.

<Operation>

An operation of the feeding mechanism 10 constituted as described above will be explained as follows.

Figure 11:
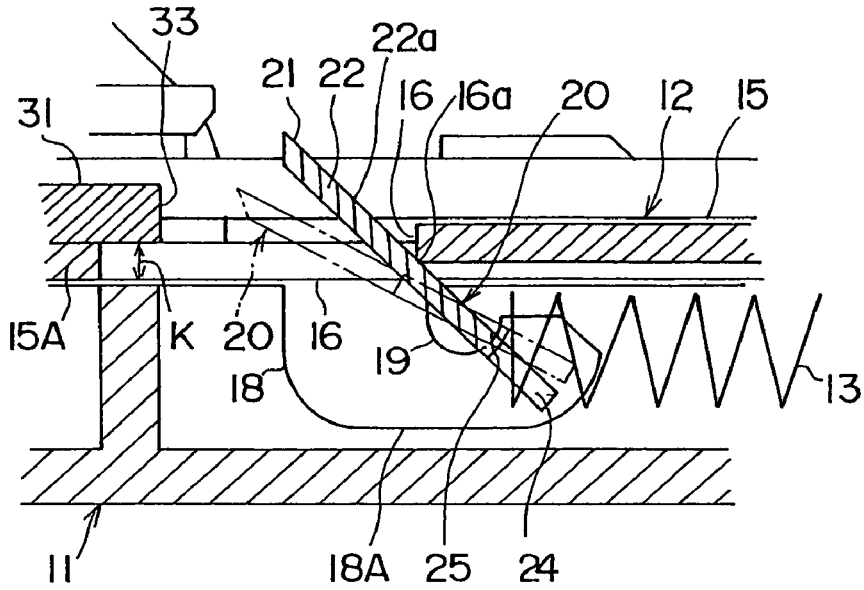
FIG. 11 is an explanatory view showing that the feeding pawl is in a raised up state.

As the stacked sheet staples (not shown) contained in the cartridge are disposed on the receiving part 31 of the staple guide 30, the feeding pawl 20 is rotated counterclockwise against the biasing force of the feeding spring 13 by means of a weight of the cartridge containing the sheet staples and then fallen down leftward as shown in the chained line in FIG. 11. This fall down of the feeding pawl causes the pawl portion 21 of the feeding pawl 20 to introduce into the opening 33 of the staple guide 30.

Figure 12:
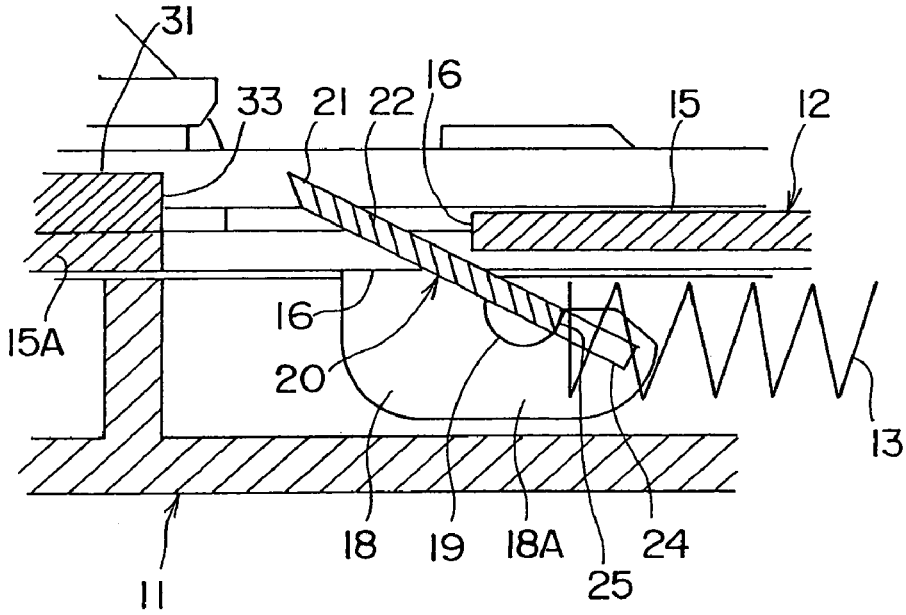
FIG. 12 is an explanatory view showing that the feeding pawl is in a collapsed state.
Figure 13:
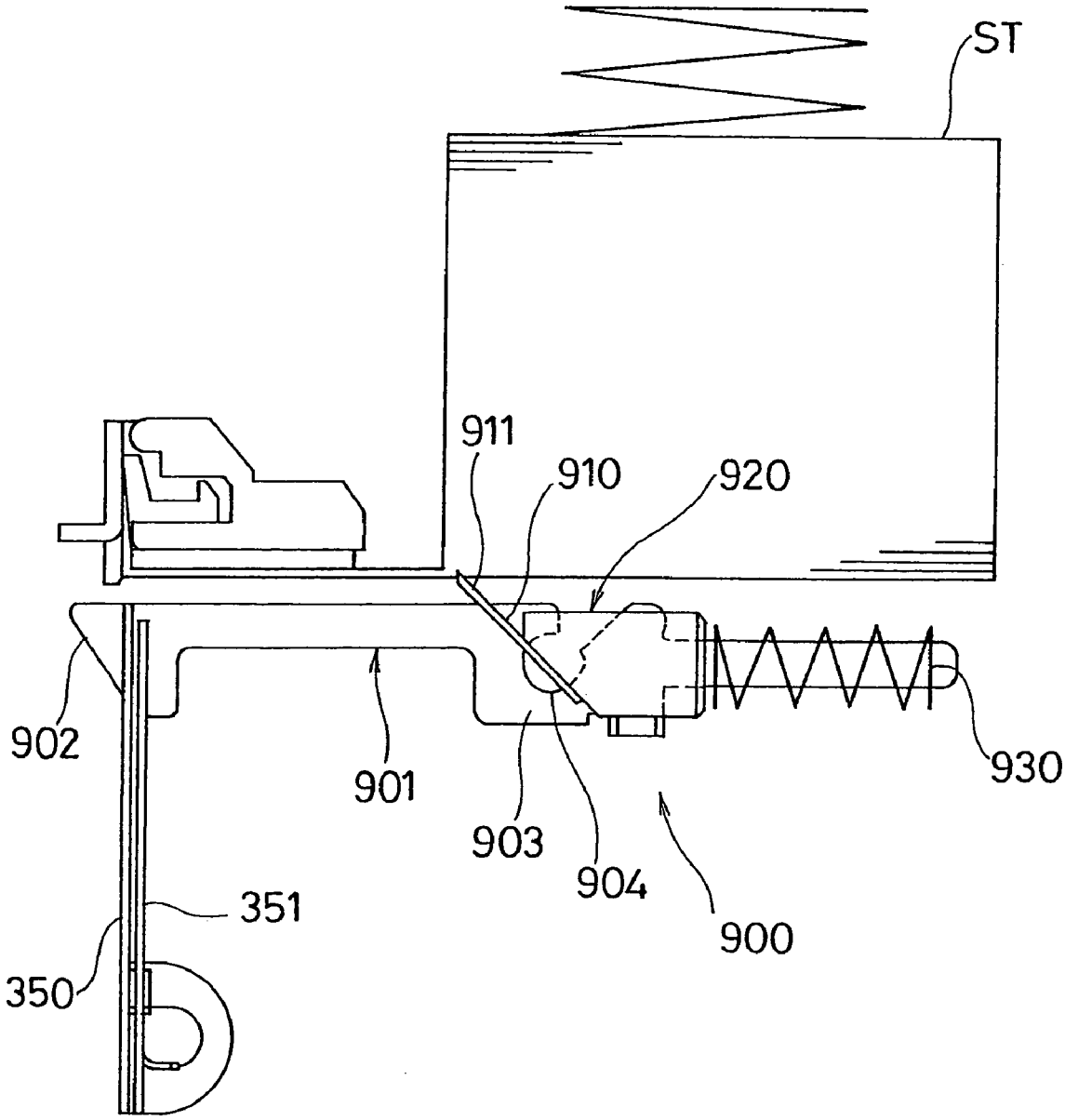
FIG. 13 is an explanatory view showing a structure of a conventional feeding mechanism.
Figure 14:
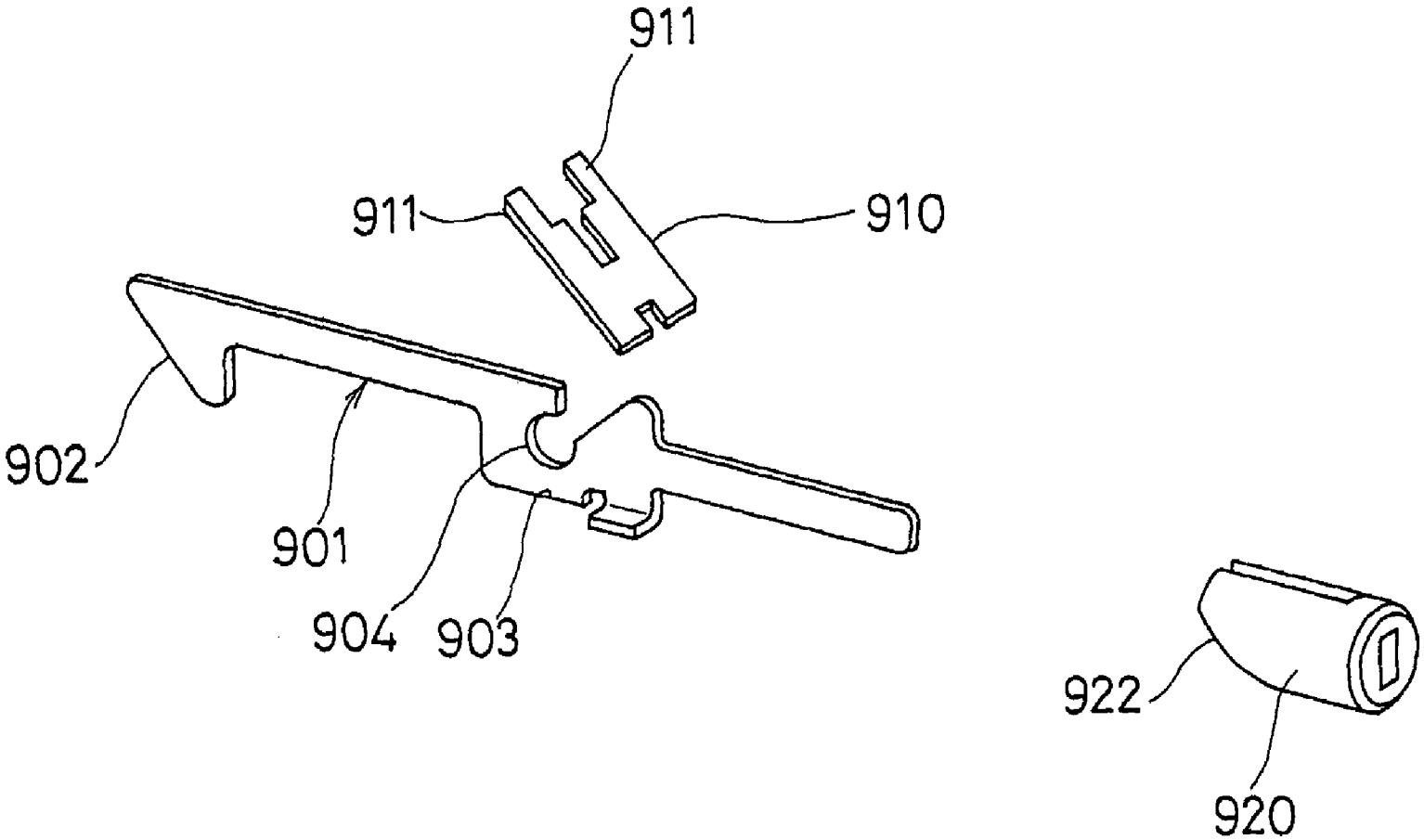
FIG. 14 is an exploded perspective view showing the structure of the conventional feeding mechanism.
Figure 15:
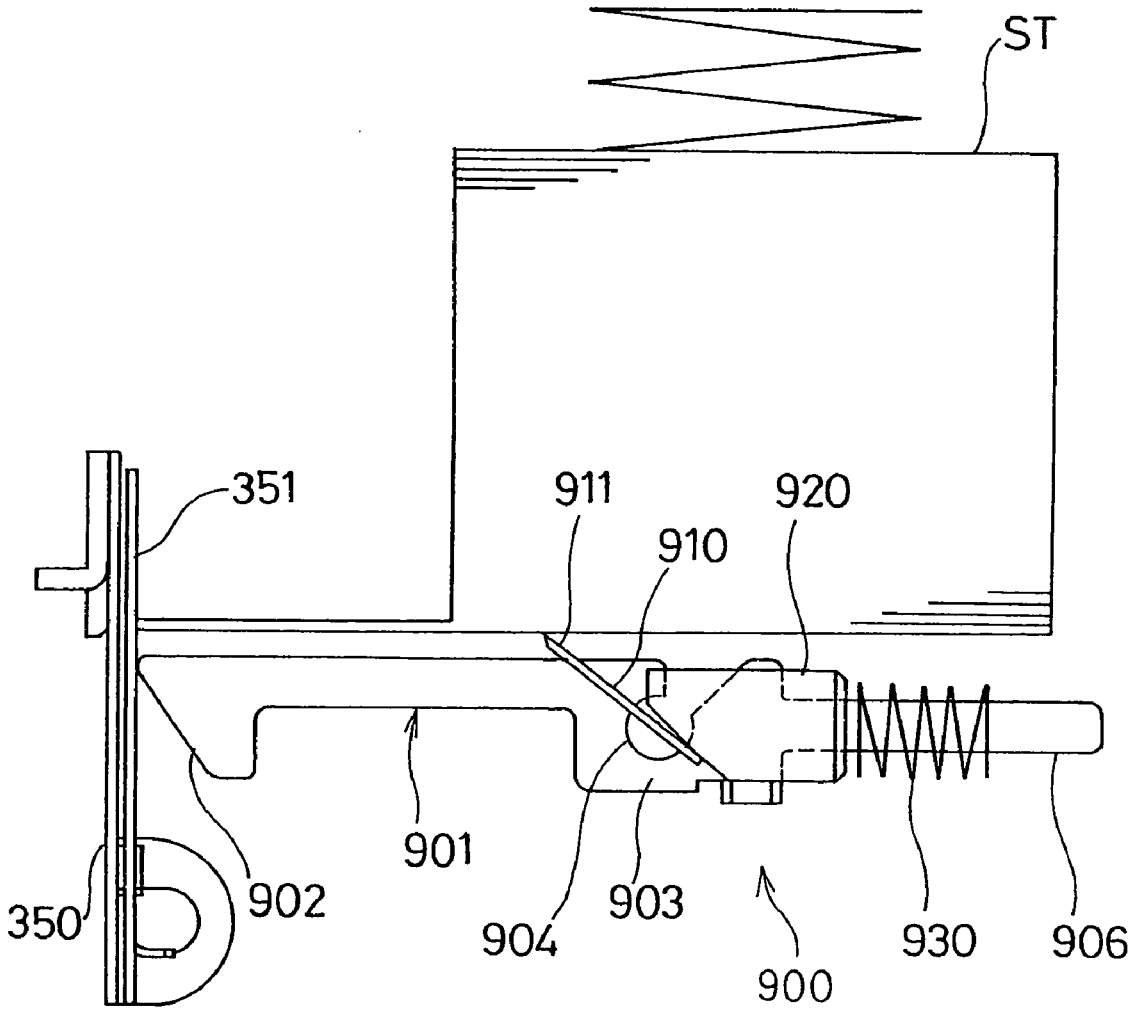
FIG. 15 is an explanatory showing a state that a ratchet plate of the feeding mechanism is retracted.

Subsequently, the reciprocating member 12 moves backwardly in a state that the feeding pawl 20 is fallen down leftward through the link mechanism (not shown) by means of the downward movement of the driver (not shown) as shown in FIG. 12.

When the driving of sheet staple ST is completed by the driver 350 and the driver 350 is returned in an initial position, the feeding pawl 20 rotates clockwise about the fulcrum P by means of the biasing force of the feeding spring 13 for the reason that the concave portion 25 of the feeding pawl 20 is positioned under the engaging portions 23 as shown in FIG. 10. The feeding pawl 20 rotates and is in the raised state until the upper surface 22*a* of the pawl plate 22 in the feeding pawl 20 is abutted with the back edge (stopper portion) 16*a* of the opening 16. The feeding pawl 20 is then fixed into a position as shown in FIGS. 10 and 11.

Further, when the concave portion 25 of the feeding pawl 20 is energized forwardly by means of the feeding spring 13, the reciprocating member 12 moves forwardly together with the feeding pawl 20 for the reason that the feeding pawl 20 is in the fixed state. Upon the movement of the reciprocating member, the pawl portion 21 of the raised feeding pawl 20 projects upwardly passing through the opening 33 of the staple guide 30 as shown in FIG. 11 and then the leading end of the pawl portion 21 enters between the sheet staples (not shown).

Consequently, the feeding pawl 20 feeds out forwardly the sheet staples in sequence, in accordance with the movement of the reciprocating member 12.

As described above, because the feeding pawl 20 raises up by means of the biasing force of the feeding spring 13 which causes the reciprocating member 12 move forwardly for the reason that the concave portion 25 of the feeding pawl 20 is disposed under the engaging portions 23, it is not necessary to provide parts for raising up the feeding pawl 20. In other words, the feeding mechanism 10 is sufficient only to have three parts of the reciprocating member 12, feeding pawl 20 and feeding spring 13 and therefore the number of parts can be minimized.

EFFECT OF THE INVENTION

As described above, according to the present invention, because the there is provided a feeding mechanism for sheet staple comprising the reciprocating member which is provided under the cartridge in which stacked sheet staples are contained and which is reciprocated forwardly and backwardly in response to up and down movements of the driver for driving the sheet staples, the feeding pawl mounted rotatably by a predetermined angle in forward and backward directions on the reciprocating member for rotating in a raised direction as the reciprocating member moves forwardly, and the spring for biasing forwardly the reciprocating member, each of the sheet staples being fed out forwardly by raising of the feeding pawl, and one end of the spring being engaged in a lower side than a center of rotation of the feeding pawl, the reciprocating member being urged forwardly through the feeding pawl, and the feeding pawl raising up by means of the biasing force of the feeding spring, it is not necessary to provide parts for raising up the feeding pawl and therefore it is possible to minimize the number of parts.

The invention claimed is:

1. A feeding mechanism for sheet staples comprising:

a reciprocating plate-like member which is provided under a cartridge in which stacked sheet staples are contained and which is parallel to a feeding out direction of the sheet staples and extends in a vertical direction with respect to an up and down moving direction of a driver and reciprocates forwardly and backwardly with respect to the moving direction of the driver, in response to up and down movements of the driver for driving each sheet staple;

a link mechanism which converts the down moving direction of the driver to backward movement of the reciprocating plate-like member;

a feeding pawl mounted rotatably, in a range of a predetermined angle around a center of rotation of the feeding pawl, on said reciprocating plate-like member; and a spring biasing said reciprocating plate-like member towards the moving direction of the driver, wherein the reciprocating plate-like member comprises a pair of supporting plate parts projecting downward from positions of the reciprocating plate-like member away from each other in a vertical direction with respect to the reciprocating plate-like member, and each of the supporting plate parts has an upper portion with a curved concave portion with respect to said plate-like member respectively, the feeding pawl has a pair of engaging portions which extend laterally and are engaged with the concave portions of the supporting plate parts respectively, and a spring receiving portion is formed at a backward end portion of the feeding pawl, the rotation of the feeding pawl is carried out about the engaging portions within the curved concave portions of the supporting plate parts, one end of said spring is engaged with the spring receiving portion of said feeding pawl under the center of rotation of said feeding pawl, and said reciprocating plate-like member is urged towards the driver through said feeding pawl via the feeding spring; by means of a driving action of the sheet staples by the driver, the feeding pawl is in a fallen state, and the reciprocating plate-like member moves backwardly with respect to the driver; and by means of a returning action of the driver to an initial upward position, the feeding pawl is rotated by a biasing force of the feeding spring and is in a raised state, and is moved forwardly towards the driver together with the reciprocating plate-like member, to feed out each sheet staple.

2. A feeding mechanism for sheet staples according to claim 1, wherein said reciprocating plate-like member is held movably forwardly and backwardly with respect to the moving direction of the driver on a staple guide holder attached to a lower portion of said cartridge, and a stopper portion is provided on the reciprocating plate-like member to stop the rotation of the feeding pawl when the feeding pawl rotates around its center of rotation by the predetermined angle.

* * * * *